US007228789B1

(12) United States Patent
Mondszein et al.

(10) Patent No.: US 7,228,789 B1
(45) Date of Patent: Jun. 12, 2007

(54) BEVERAGE CONTAINER

(75) Inventors: Karl Mondszein, Nottinghamshire (GB); Mark Philip Radford, Bedfordshire (GB); Sian Bronwyn Gastall, Bedfordshire (GB)

(73) Assignees: Whitbread PLC, London (GB); Lawson Marden Packaging UK Limited, Bristol (GB); Heineken Technical Services BV, Amsterdam (NL)

( * ) Notice: Subject to any disclaimer, the term of this patent is extended or adjusted under 35 U.S.C. 154(b) by 0 days.

(21) Appl. No.: 09/979,895

(22) PCT Filed: May 5, 2000 (Under 37 CFR 1.47)

(86) PCT No.: PCT/GB00/01704

§ 371 (c)(1), (2), (4) Date: Aug. 20, 2002

(87) PCT Pub. No.: WO00/69746

PCT Pub. Date: May 5, 2000

(30) Foreign Application Priority Data

May 18, 1999 (EP) ..... 99030837

(51) Int. Cl.
*B65D 51/16* (2006.01)
*B65D 83/44* (2006.01)

(52) U.S. Cl. ..... 99/277; 205/454; 220/23.83; 220/23.86; 220/203.11; 220/203.19; 220/203.29; 220/501; 220/503; 220/505; 222/212; 426/124; 426/131

(58) Field of Classification Search ..... 426/124, 426/131; 222/212; 205/454; 99/277; 220/203.11, 220/203.19, 203.29, 89.1, 745, 906, 23.86, 220/23.83, 501, 503, 505
See application file for complete search history.

(56) References Cited

U.S. PATENT DOCUMENTS 4,139,032 A * 2/1979 Taylor et al. ..... 141/206
5,333,761 A * 8/1994 Davis et al. ..... 222/212

FOREIGN PATENT DOCUMENTS

| | | |
|---|---|---|
| GB | 2 272 199 A | 5/1994 |
| GB | 2 286 379 A | 8/1995 |
| GB | 2 310 190 A | 8/1997 |
| GB | 2 322 614 A | 9/1998 |
| WO | WO 93 09055 A | 5/1993 |

* cited by examiner

*Primary Examiner*—Arthur L. Corbin
(74) *Attorney, Agent, or Firm*—Sughrue Mion, PLLC

(57) ABSTRACT

A beverage container for a carbonated beverage includes a floating hollow insert (1) comprising an upper moulding (2) and a lower moulding (3) defining a chamber for containing gas, a first one-way duck-bill type valve (4) integrally formed with the upper moulding (2) at the bottom of a down pipe (6) and arranged to allow gas to enter the chamber and a second duckbill valve (5) integrally formed with the lower moulding (3) and arranged to allow gas to exit the chamber and be jetted into the beverage upon opening the beverage container.

12 Claims, 2 Drawing Sheets

BEVERAGE CONTAINER

FIELD OF THE INVENTION

This invention relates to a beverage container for a carbonated beverage which enables a close-knit creamy head to be formed on the beverage as it is dispensed so that it has an appearance similar to that of a beverage dispensed from draught.

BACKGROUND TO THE INVENTION

Such an appearance can be achieved by causing shear of the beverage. This encourages the liberation of small bubbles from the beverage and these gradually separate out to form the close-knit creamy head. It is well known that shear of the beverage can be caused by jetting fluid into the beverage in the container.

Various methods have been disclosed for jetting fluid into a beverage in a container upon opening of the container to cause shear of the beverage. GB-A-1,266,351 discloses a container which includes an inner secondary chamber which is pre-pressurised with gas. The chamber is initially sealed with a soluble plug which dissolves shortly after filling the container with beverage, when the pressure in the container is similar to that in the secondary chamber. A small orifice is included in the secondary chamber, and fluid is jetted from the secondary chamber via the orifice into the main body of the container causing the liberation of the required small bubbles in the beverage.

GB-A-2,183,592 discloses a container including a separate hollow insert having an orifice in its side wall. As the container is filled, beverage is introduced into the hollow insert through the orifice. Upon opening the container, beverage from the insert is jetted through the orifice into the beverage in the container again causing shear of the beverage.

WO-A-91/07326 discloses a system in which an insert which jets gas only into the beverage in the main body of the container is pre-pressurized with gas and includes closure means. The closure means remains sealed before filling and during the container filling operation but when the beverage container is subsequently opened, de-pressurization of the beverage container results in the insert releasing a surge of gas from a restricted orifice into the beverage to "seed" the required nucleation of dissolved gas bubbles to produce the required rich creamy foam. Since the insert is sealed at all material times before the container is finally opened by the consumer the container and insert combination can be filled as easily, simply and quickly as conventional container. Examples of the closure means includes a burst disc and a pressure responsive valve. A disadvantage of this type of system is that the insert may contain a residual pressure after the container has been emptied. There is a risk a consumer will cut open the empty container and thus be able to interfere with a pressurised insert.

WO-A-91/07326 discloses a very large number of ways in which the pressurized gas insert can be formed and mounted within the beverage container. In most examples, the insert is mounted so that, in use, it is located at a fixed position. However, an example is also described where the insert floats in the liquid in the container.

A problem which occurs with fixed inserts results from the way in which a container is handled during opening. When opening a bottle with a crown cork type closure the bottle is often tipped almost horizontally if opened using a fixed opener. Equally when opening an easy open feature, either a ring pull or a stay-on-tab on a can it is common to tilt the can on opening. In both cases, immediately after opening the closure the container is then tipped to dispense its contents. These actions can result in the restricted orifice of the insert not being immersed in the beverage whilst gas is being jetted from it. In such a case the insert does not function correctly.

GB-A-2280887 discloses a carbonated beverage container including a floating hollow insert having a first duckbill valve arranged to allow gas to enter the insert, and a second duckbill valve arranged to allow gas to be jetted from the insert. The insert is arranged to float on the beverage with the first valve in a headspace above the beverage, and with the second valve below the surface of the beverage.

The insert of GB-A-2280887 does not have to be pre-pressurized. As the insert floats on the beverage, the insert may be dropped into the container before or after filling, and therefore the assembly of the container and insert is much simpler than for containers in which the insert is fixed in the container. As the insert floats, the problems of orientation, including gas not being jetted into the beverage, and beverage entering the insert, which are associated with fixed inserts, are overcome. Further, the nature of the containers is not critical since it is not necessary to form an interference fit with them, or adapt them specifically to hold the insert at a particular location.

The use of duckbill valves through which fluid is jetted in the insert of GB-A-2280887 is particularly beneficial. The size of the aperture through which the fluid is jetted varies with the pressure difference across the valve and the nature of the fluid being jetted. This variation in the size of the aperture ensures the fluid jetting into the beverage causes optimum shear. This allows the volume of fluid required for jetting into the beverage to be reduced when compared to the volume required when jetting through a fixed size orifice.

The insert of GB-A-2280887 may be moulded from a plastics material such as polypropylene, or be formed of metal such as lacquered aluminium, lacquered tin plate, polymer coated aluminium, polymer coated tin plate or tin free steel. The duckbill valves are manufactured from a thermoplastic elastomer (TPE), for example a styrene-ethylene-butylene-styrene block co-polymer, and are mounted in holes in the wall of the insert. This complicates assembly of the insert and there is a danger that the valves may become separated from the insert and be swallowed. Furthermore, manufacture of duckbill valves from TPE is problematic, as described in our earlier specification GB-A-2292708. As TPE is elastic, the slit in a TPE duckbill valve cannot be formed by the usual method of mechanical splitting to form a brittle fracture. GB-A-2292708 describes a method of manufacturing TPE duckbill valves in which the slit is formed by fluid pressure.

DISCLOSURE OF THE INVENTION

According to the present invention, a beverage container for a carbonated beverage includes a floating hollow insert comprising an upper moulding and a lower moulding defining a chamber for containing gas, means including a one-way duck-bill type valve being arranged to allow gas to enter the chamber and to exit the chamber and be jetted into the beverage upon opening the beverage container is characterised in that the one-way duckbill type valve is integrally formed with at least one of the mouldings.

According to a second aspect of the present invention, a floating hollow insert for use in a beverage container for a carbonated beverage comprises an upper moulding and a lower moulding defining a chamber for containing gas, means including a one-way duck-bill type valve integrally formed with at least one of the mouldings, the means being arranged to allow gas to enter the chamber and to exit the chamber and be jetted into the beverage upon opening the beverage container.

Integrally forming the duckbill valve with one of the mouldings considerably reduces the cost of materials, manufacturing and assembly of the insert. There is also no separate component which may become detached from the insert into the beverage and be swallowed.

As the insert allows gas to enter to pressurise the insert, the insert need not be pre-pressurised. Gas may enter the insert through a gas permeable membrane, hole but preferably through a second one-way valve.

Preferably a first duckbill valve is integrally formed with the upper moulding, and is arranged to allow gas to enter the chamber, and a second duckbill valve is integrally formed with the lower moulding to allow gas to be jetted into the beverage. The variation in the size of the aperture of the duckbill valve with pressure ensures the gas is jetted at a substantially constant velocity. The insert is arranged to float on the beverage with the first duckbill valve in a headspace above the beverage, and with the second duckbill valve below the surface of the beverage.

The first duckbill valve may have a pre-loading, which requires the pressure difference across the valve to exceed a pre-determined level for the valve to open. In this way, after the insert has been pressurized, in the unlikely event of the first duckbill valve being submerged below the surface of the beverage, a small pressure difference across the valve created as a result of its immersion for example does not open the valve, and therefore no beverage enters the insert.

Preferably, the insert is made from a plastics material, and the duckbill valves comprise an elongate slit. Preferably the insert is made from a thermoplastic polymer such as nylon, PET or polyethylene, but polypropylene is preferred. The polypropylene duckbill valves of the present invention do not open under pressure to give an elliptical orifice, as do the prior art TPE valves. The thin slit causes sufficient shear of the beverage on jetting, even if a wide slit is used. Because a wider slit can be used, the slit can have a greater area when open and a faster response time. Typically, a slit of 2 to 7 mm wide is used, which is wider than typical prior art TPE valves. Gas passage through the slit is substantially instantaneous compared to TPE valves which require about a second to fully charge and vent during flushing of the container with inert gas to remove oxygen before filling with beverage. Furthermore, manufacture of the valves is easier than TPE duckbill valves, as the slit can be formed directly during the moulding cycle and does not require a separate slitting process as with TPE duckbills.

Preferably, the two parts of the insert are joined by hot plate welding or ultrasonic welding although they may be snap-fitted together.

Preferably, the first duckbill valve is formed at the bottom of a down pipe extending into the chamber so that the bottom of the down pipe is adjacent the second duckbill valve. This feature ensures the insert does not fill with beverage in the event that valve leakage occurs.

Preferably, the second duckbill valve protrudes from the insert and is surrounded by a protective skirt.

Preferably, the upper moulding has a generally hemispherical domed shape, and the lower moulding is generally flat. The lower moulding is preferably formed from thicker material than the upper moulding. This keeps the insert floating the correct way up with the second duckbill valve below the surface of the beverage, and provides good stability. The generally flattened shape of the lower moulding reduces the floatation height compared to a sphere of the same volume, hence minimising the extra space required in the top of a can to accommodate the insert. This design feature enables use of significantly less material than a simple spherical device of similar volume. Typically with this design a 10 ml volume device can weigh only 2.0 g compared to a similar commercial device weighing 3.5 g. A spherical device of only 2.0 g would float too high above the beverage surface. This device has the smaller volume and floats lower.

Preferably, the inside surface of the lower moulding is shaped to slightly slope towards the second duckbill valve. This ensures drainage of any liquid out of the insert which enters during filling or dosing of the can.

The effective volume of the inside of the insert is preferably between 1 and 20 ml, depending upon the size of the container, and the type of beverage, but more preferably the volume is approximately 10 ml.

BRIEF DESCRIPTION OF THE DRAWINGS

Particular examples of the present invention will now be described with reference to the accompanying drawings, in which:—

DETAILED DESCRIPTION OF PREFERRED EMBODIMENT

Figure 1:
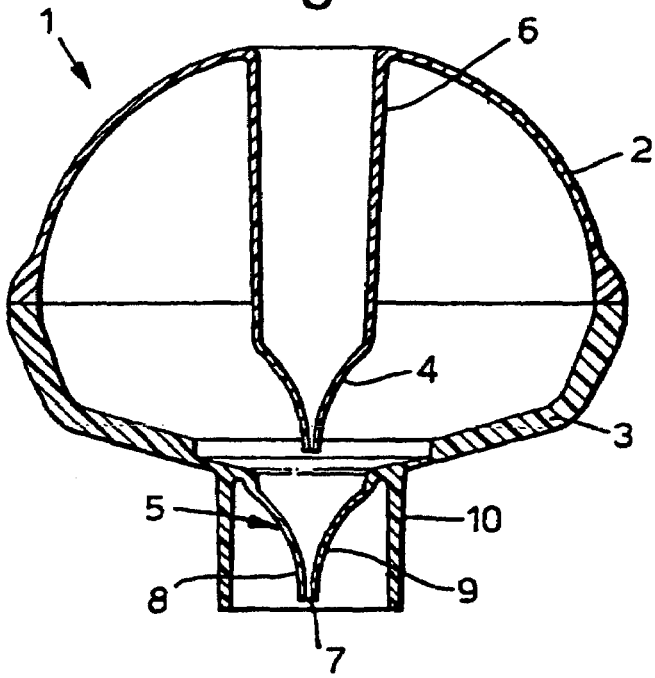
FIG. 1 shows in cross-section an example of an insert for use in a container according to the present invention.
Figure 2:
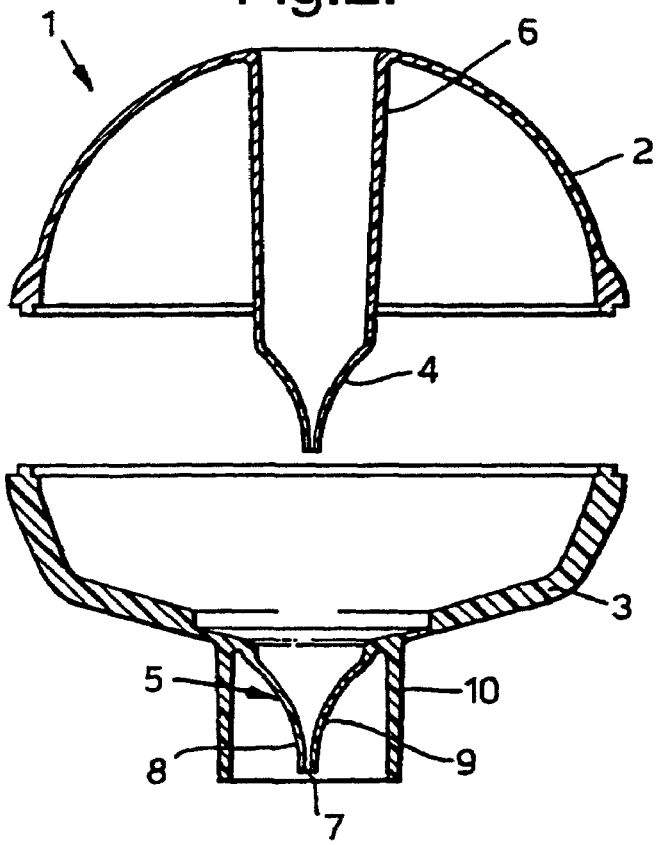
FIG. 2 shows in cross-section the upper and lower mouldings of an insert for use in a container according to the present invention before welding.
Figure 3:
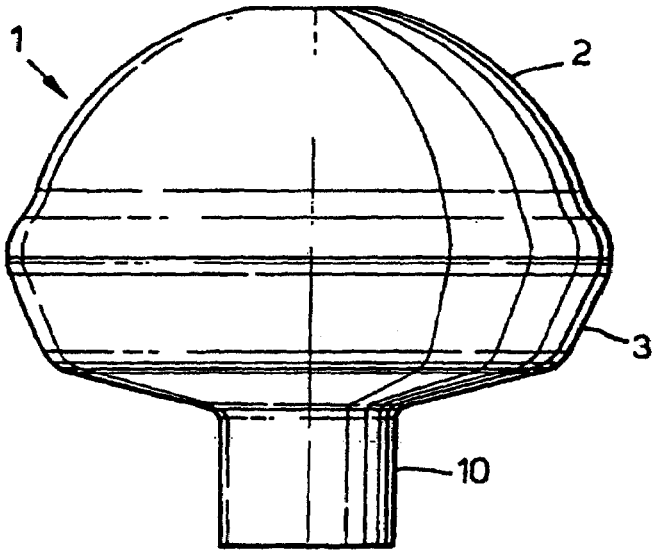
FIG. 3 shows an assembled insert for use in a container according to the present invention.

FIG. 1 shows a cross section of an insert for use in a container according to the present invention. The insert 1 is formed from an upper moulding 2, and a lower moulding 3 which are hot plate welded together. FIG. 2 shows the two mouldings 2, 3 prior to welding. A first duckbill valve 4 is integrally formed with the upper moulding 2, and a second duckbill valve 5 is integrally formed with the lower moulding 3. The first duckbill valve is formed at the end of a down pipe 6 which extends from the top of the insert to a point adjacent the second duckbill valve 5. The down pipe 6 prevents the insert from filling with liquid above the level of the first duckbill valve in the event that valve leakage occurs. The second valve 5 is surrounded by a protective skirt 10. FIG. 3 shows a complete insert 1.

Figure 4:
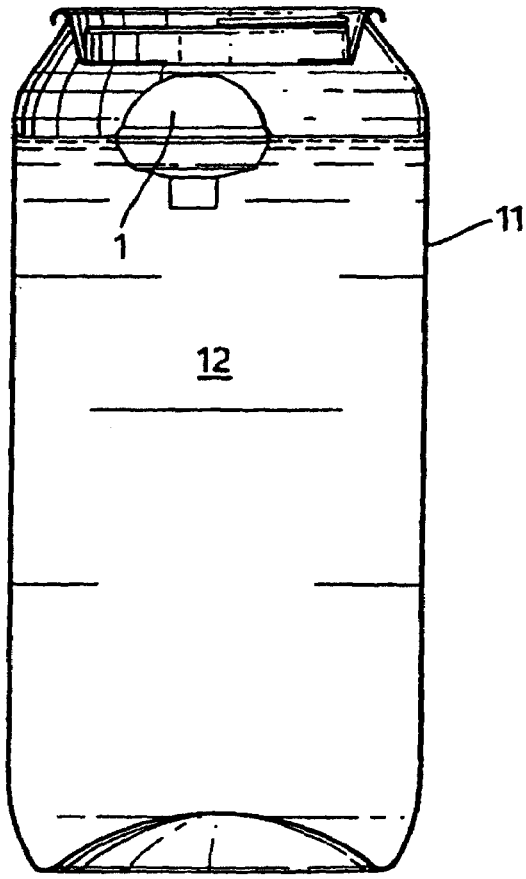
FIG. 4 shows a beverage container according to the present invention.

FIG. 4 illustrates a beverage container 11 according to the present invention. When filling the container 11, the insert 1 is dropped into the container 11, and the container 11 and insert 1 are together flushed with inert gas to remove any oxygen from the inside of both container 11 and insert 1. The container 11 is then filled with carbonated beverage 12, dosed with liquid nitrogen, and sealed. After sealing the container 11, the contents are heated to pasteurise the beverage.

During heating, the pressure in the container 11 increases. The increase in pressure causes the first duckbill valve 4 to open and gas from the headspace to enter the insert 1. The internal pressure of the insert 1 does not exceed the internal pressure of the container 11, so the second duckbill valve 5 remains closed. After pasteurisation, the beverage 12 cools and the internal pressure of the container 11 decreases. The internal pressure of the insert 1 then exceeds the internal pressure of the container 11, and the second duckbill valve 5 opens allowing gas from the insert 1 to be ejected into the beverage 12. In this way, the internal pressure of the container 11 and the insert 1 remain in equilibrium.

Upon opening of the container 11, the internal pressure of the container 11 rapidly vents to atmospheric pressure. At this time, the internal pressure of the insert 1 is higher than that of the container 11, and accordingly gas from the insert 1 is jetted into the beverage 12 via the second duckbill valve 5. The jet of gas causes shear in the beverage 12 with a resulting liberation of a number of small bubbles which, as they rise through the beverage 12 in the container 11, form nucleation sites which trigger the liberation of further small bubbles throughout the beverage 12. As the beverage 12 is poured out of the container 11 and into a receptacle such as a drinking glass the bubbles from the top surface of the beverage 12 are intimately mixed with the remainder of the beverage as it is dispensed. This triggers the release of further small bubbles throughout the beverage to give the appearance of dispensing the beverage from draught.

The insert 1 with integral duckbill valves 4,5 is made from polypropylene. Each valve 4,5 is formed from an elongate slit 7 defined by lips 8, 9. The valve 5 allows fluid to flow through the elongate slit 7 by forcing the lips 8, 9 apart. Fluid is prevented from flowing in the reverse direction as the lips 8, 9 are forced together.

The use of a duckbill valve 5 for jetting gas into the beverage is especially beneficial since, as the pressure difference between the inside of the insert 1 and the inside of the container 11 reduces, the size of the aperture of the duckbill valve 5 also reduces, and the velocity of gas jetted into the beverage 12 remains substantially constant until the internal pressures of the insert 1 and container 11 are substantially the same. The velocity of the jet of gas remains constant for a longer period than when jetted through a simple orifice. Accordingly, the volume of gas needed to give the required jetting velocity for the required duration to shear the beverage is smaller than is necessary where the fluid is jetted through a simple orifice.

The use of polypropylene duckbill valves 4,5 is also particularly advantageous. The valves 4, 5 do not open under pressure to give a full circular orifice, as do the prior art TPE valves. The thin slit 7 causes sufficient shear of the beverage on jetting, even if a long slit is used. Because a longer slit can be used, the slit 7 can have a greater area when open and a faster response time. Manufacture of the valves is also easier than TPE duckbill valves, as the slit can be formed directly during the moulding cycle and does not require a separate slitting operation as with TPE duckbills.

The lower moulding 3 of the insert 1 is made with a greater wall thickness than the upper moulding 2 so that the insert 1 tends to float with the lower moulding 3 lowermost since the plastics material has a negative buoyancy. The upper moulding 2 has a generally hemispherical shape, and the lower moulding 3 is generally flat. This reduces the floatation height compared to a sphere of the same volume, hence minimising the extra space required in the top of a can to accommodate the insert.

Although the upper and lower mouldings 2, 3 are illustrated as connected together such that the slits 7 of the two duckbill valves 4, 5 are aligned, the upper and lower mouldings 2, 3 may be connected such that the slits are orientated at any angle to each other.

The internal volume of the insert 1 depends upon the beverage contained in the container, but is typically approximately 10 ml.

The invention claimed is:

1. A beverage container for a carbonated beverage including a floating hollow insert (1) comprising an upper moulding (2) and a lower moulding (3) defining a chamber for containing gas, means (4) for allowing gas to enter the chamber and a first one way duckbill type valve (5) for allowing gas to exit the chamber and be jetted into the beverage upon opening the beverage container, wherein the one way duckbill type valve (5) is integrally formed with at least one of the mouldings (2, 3).

2. A beverage container including a floating hollow insert (1) as claimed in claim 1 wherein the means for allowing gas to enter the chamber comprises a second one way duckbill valve (4) integrally formed with the upper moulding (2), and arranged to allow gas to enter the chamber, and wherein the first one way duckbill type valve (5) is integrally formed with the lower moulding (3) to allow gas to be jetted into the beverage.

3. A beverage container including a floating hollow insert (1) as claimed in claim 2 wherein each duckbill valve (4,5) comprises an elongate slit (7) having a width of 4 to 7 mm.

4. A beverage container including a floating hollow insert (1) as claimed in claim 2 wherein the first duckbill valve (5) protrudes from the insert and is surrounded by a protective skirt (10).

5. A beverage container including a floating hollow insert (1) as claimed in claim 2 wherein the inside surface of the lower moulding (3) is shaped to slightly slope towards the first duckbill valve (5).

6. A beverage container including a floating hollow insert (1) as claimed in claim 5 wherein each duckbill valve (4,5) comprises an elongate slit (7) having a width of 4 to 7 mm.

7. A beverage container including a floating hollow insert (1) as claimed in claim 2 wherein the second duckbill valve (4) is formed at the bottom of a down pipe (6) extending into the chamber so that the bottom of the down pipe is adjacent the first duckbill valve (5).

8. A beverage container including a floating hollow insert (1) as claimed in claim 1 wherein the second one-way duckbill valve (4) has a pre-loading, which requires the pressure difference across the valve (4) to exceed a predetermined level for the valve to open.

9. A beverage container including a floating hollow insert (1) as claimed in claim 1 wherein the insert (1) is made from a thermoplastic polymer.

10. A beverage container including a floating hollow insert (1) as claimed in claim 1 wherein the insert is made from polypropylene.

11. A beverage container including a floating hollow insert (1) as claimed in claim 1 wherein the two parts (2,3) of the insert are joined by hot plate welding.

12. A beverage container including a floating hollow insert (1) as claimed in claim 1 wherein the upper moulding (2) has a generally hemispherical domed shape, the lower moulding (3) is generally flat and the lower moulding (3) is formed from thicker material than the upper moulding (2).

* * * * *